US011067256B2

(12) United States Patent
Kinsley

(10) Patent No.: US 11,067,256 B2
(45) Date of Patent: Jul. 20, 2021

(54) MODULAR LIGHT EMITTING DIODE FIXTURE HAVING ENHANCED INTERCONNECT PINS BETWEEN MODULAR COMPONENTS

(71) Applicant: Lake and Wells, LLC, Chicago, IL (US)

(72) Inventor: Mark Anthony Kinsley, Chicago, IL (US)

(73) Assignee: Lake and Wells, LLC, Carrboro, NC (US)

( * ) Notice: Subject to any disclaimer, the term of this patent is extended or adjusted under 35 U.S.C. 154(b) by 0 days.

(21) Appl. No.: 16/791,014

(22) Filed: Feb. 14, 2020

(65) Prior Publication Data

US 2020/0263859 A1 Aug. 20, 2020

Related U.S. Application Data

(60) Provisional application No. 62/808,117, filed on Feb. 20, 2019.

(51) Int. Cl.

| | |
|---|---|
| ***F21V 19/00*** | (2006.01) |
| ***F21S 2/00*** | (2016.01) |
| *F21Y 115/10* | (2016.01) |
| *F21S 8/04* | (2006.01) |
| *F21S 4/20* | (2016.01) |

(52) U.S. Cl.

CPC ..... *F21V 19/0025* (2013.01); *F21S 2/005* (2013.01); *F21V 19/0035* (2013.01); *F21S 4/20* (2016.01); *F21S 8/046* (2013.01); *F21Y 2115/10* (2016.08)

(58) Field of Classification Search

CPC .. F21V 19/0025; F21V 19/0035; F21S 2/005; F21S 4/28; F21S 8/046; F21S 8/063; F21S 13/14; F21S 4/20; F21Y 2115/10

See application file for complete search history.

(56) References Cited

U.S. PATENT DOCUMENTS

| | | | | |
|---|---|---|---|---|
| 2011/0013395 | A1* | 1/2011 | Melzner | F21S 2/005 362/249.02 |
| 2013/0114262 | A1* | 5/2013 | McClellan | F21S 8/046 362/249.03 |
| 2018/0213627 | A1* | 7/2018 | Xia | F21S 4/20 |
| 2019/0162397 | A1* | 5/2019 | Sonneman | F21S 2/005 |

OTHER PUBLICATIONS

Declaration of Mark A. Kinsley, dated Jun. 3, 2020, 4 pages.

Everett Charles Technologies, Contact Products Group, LFRE Brochure, "Lead-Free POGO Spring Probes", https://ect-cpg.com/wp-content/uploads/2015/09/LFRE_Brochure_0716.pdf, 2009-2017, accessed Feb. 10, 2021, 6 pp.

Everett Charles Technologies, Products—Spring Probes, "POGO Pin Spring Contact Probe Solutions for the PCT Testing Industry", https://ect-cpg.com/spring-probes, accessed Feb. 10, 2021, 7 pp.

(Continued)

*Primary Examiner* — Y M. Lee

(74) *Attorney, Agent, or Firm* — Fitch, Even, Tabin & Flannery LLP

(57) ABSTRACT

The present disclosure relates to modular LED fixtures that have improved electrical connection between modular components of the fixture. The improved electrical connection is achieved through pins having a non-flat head, such as a generally hemispherical head.

9 Claims, 6 Drawing Sheets

(56) References Cited

OTHER PUBLICATIONS

Feinmetall Contact Technologies, "Contact Probes for PCT Testing Brochure", http://www.feinmetall.com/fileadmin/FM-Homepage/Dateien_Downloadseite/2017_Leiterplattentest_EN_klein_.pdf, accessed Feb. 10, 2021, 108 pp.
Peak Test Services, Ltd., Test Probe Guides, "What is a Spring Contact Test Probe?", https://www.peaktest.co.uk/about/product-guides/what-is-a-spring-probe, accessed Feb. 10, 2021, 4 pp.

* cited by examiner

MODULAR LIGHT EMITTING DIODE FIXTURE HAVING ENHANCED INTERCONNECT PINS BETWEEN MODULAR COMPONENTS

CROSS-REFERENCE TO RELATED APPLICATION

This application claims the benefit of U.S. Provisional Application No. 62/808,117, filed Feb. 20, 2019, which is hereby incorporated herein by reference in its entirety.

FIELD

The following disclosure relates to modular light emitting diode (LED) fixtures and specifically to modular LED fixtures having enhanced interconnect pins for connecting modular components of a modular LED fixture.

BACKGROUND

Since their inception incandescent light bulbs and other non-polar light emitting elements have dominated the marketplace for lighting elements. Recently, LED lighting elements have begun to displace incandescent bulbs and other conventional lighting elements, and accordingly, the demand for LED light fixtures has increased.

LED light fixtures operate using direct current (DC) power, and for that reason, they are fundamentally different than fixtures that use alternating current (AC) power such as, for example, incandescent bulbs. Incandescent bulbs can produce a constant light source in response to an alternating current. If an incandescent light bulb is connected to an AC power source, the direction of the current flowing across the incandescent lighting element will change each time the polarity of voltage across the terminals of the incandescent lighting element flips. Because of this, the incandescent lighting element of the incandescent light bulb can be modelled as a resistor. A resistor is a non-polar circuit element, and thus, the incandescent light bulb will produce light continuously and in proportion to the heat dissipated across the incandescent lighting element regardless of the direction of the current flowing through the resistor.

As opposed to the incandescent lighting elements, LED lighting elements are polar, and therefore, only produce light when a voltage of the proper polarity (forward bias) is applied to the LED lighting element causing current to flow in the proper direction to produce light. Fundamentally, an LED is a semiconductor device having a PN-junction and light will be produced when free electrons flow from the N-type region and into the P-type region allowing the free electrons to combine with positive charge carriers that are travelling from the P-type region to the N-type region. When a free electron combines with positive charge carrier in an LED lighting element, the free electron falls from a higher energy orbital to a lower energy orbital, and as a result, the LED lighting element emits energy in the form of light.

When the polarity of the voltage source attached to an LED flips (is reverse biased), free electrons cannot combine with positive charge carriers and light will not be produced by the LED lighting element, or in other words, current will neither flow through the LED lighting element nor produce light. Thus, the effect of connecting an LED lighting element to an AC power source is that the LED will blink, and blinking is a very undesirable quality for light fixtures designed to provide a continuous light source. To address this problem, LED light fixtures include power converters that convert AC power from the grid to DC power desirable for powering LED light fixtures.

LEDs are very sensitive to reversed bias current and will burn out if too much current is made to flow when the LED lighting element is operating in a reversed bias mode. Thus, it is critical that modular LED lighting fixtures are installed with all LED lighting elements having a forward bias. Typically, properly biasing each LED is achieved through painstaking and time-consuming manual wiring of an LED light fixture.

Therefore, there is a need for LED light fixtures that can be quickly installed and avoid the need to manually wire each LED element during installation. This desire includes being able to prevent installation of LED elements in a reversed bias and, thus, eliminate installation error and decrease installation time. It is further desired to reduce shipping cost for these lighting fixtures.

DETAILED DESCRIPTION

Modular LED light fixtures that can be quickly installed and avoid the need to manually wire each LED element during installation are disclosed. The modular LED light fixtures prevent installation of LED elements in a reversed bias configuration and, thus, eliminate installation errors and decrease installation time. Because the LED fixtures are modular, they can easily be shipped, and the need to assemble the LED light fixtures before shipping is eliminated.

A modular LED light fixture may be an LED lighting fixture having a power source that converts AC power to DC power. One or more connecting elements may connect the power source to the LED lighting elements of the LED fixture. For example, a connecting element may be couple to the power source. The connecting element will have at least one transfer junction having a transfer junction connecting element. A light emitting diode lighting circuit device containing an LED lighting element may be coupled to the power source and the connecting element. The light emitting diode lighting circuit device has, for example, at least one LED lighting element, such as a light emitting diode, at least one transfer junction having a transfer junction connecting element, and a polarity circuit coupled to the transfer junction connecting element and the light emitting diode. The polarity circuit is configured to maintain the voltage across the at least one light emitting diode in a first polarity regardless of the polarity of the voltage across a corresponding transfer junction connecting element.

The transfer junction connecting element of the light emitting diode lighting circuit device may have transfer junction contact elements that are either pins or pads for coupling with the pins or pads of a transfer junction connecting element of a connecting element, such as a hub or an elongated connecting member. If the transfer junction connecting element of a transfer junction has pins, then it will couple with a transfer junction connecting element that has pads and vice versa. The mechanical coupling of the pins and pads also serves as an electrical coupling to power the LED lighting elements. The light emitting diode lighting circuit device is powered by contact between at least two pins and at least two pads, and the pins have a non-flat terminal end, such as a substantially round or hemispherical terminal end, for contacting the pads. The substantially rounded or hemispherical terminal end or head provides superior electrical conductivity.

Figure 1:
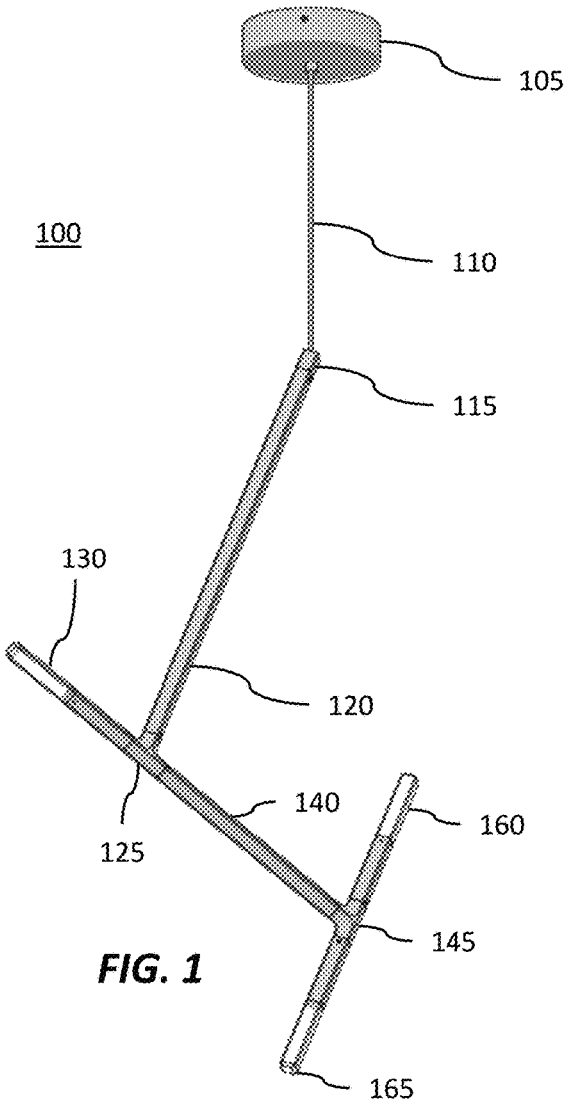
FIG. 1 is a perspective view of an example of a modular LED fixture designed to be installed on a ceiling.

With reference to FIG. 1, a modular LED light fixture 100 is illustrated. The modular LED light fixture 100 comprises a power converter 105 coupled to interface device 115. The power converter 105 takes AC power as an input and outputs DC power usable by the LED light fixture 100. The power converter 105 may convert the AC power to have any appropriate DC voltage level for powering the modular LED light fixture 100. For example, the power converter 105 may output a power at 12, 18 or 24 volts. The power converter 105 may be further configured to be installed in a residential or commercial structure by affixing the power converter 105 to the residential or commercial structure and electrically coupling the power converter 105 to an AC power source supplied by the residential or commercial structure.

A wire 110 couples the power converter 105 to the interface device 115. The wire 110 may be any commercially available wire adequate to support the current draw and weight of the LED light fixture 100. The wire 110 may be mechanically coupled to the interface device 115. The mechanical couple between the wire 110 and the interface device 115 may be with a mechanical gripping of the wire or other method such as using an adhesive affixing the wire to the interface device 115. The wire 110 may further include both an inner wire or wires for creating an electrical connection between the power source 105 and the remainder of the LED light fixture 100 and an outer shield or supporting wire capable of bearing the weight of the LED light fixture 100. In this case, the outer shield or supporting wire will be mechanically coupled to the interface 115 for the purpose of supporting the LED light fixture 100, and the inner wire or wires will be coupled to the interface device 115 merely for establishing an electrical connection between the power source 105 and the interface device 115. In some cases, the weight may be distributed between the inner wire or wires and the sheath or support wire. In such a case, the inner wire or wires will be electrically and mechanically coupled to the interface device 115 such that they are each capable of bearing a portion of the weight of the LED light fixture 100 without compromising the electrical connection between the power converter 105 and the interface device 115.

Figure 3:
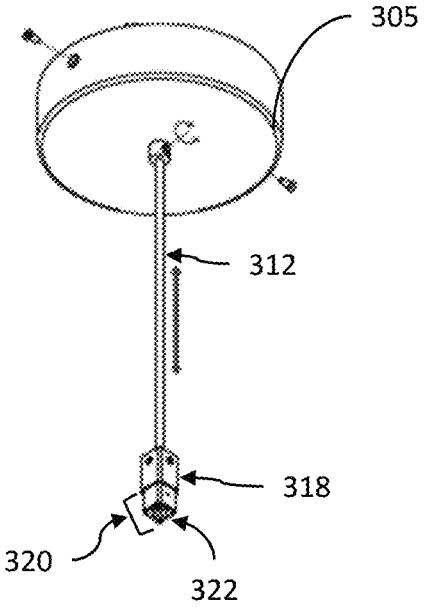
FIG. 3 is a perspective view of an example of a DC power converter assembly for a modular LED fixture.
Figure 4:
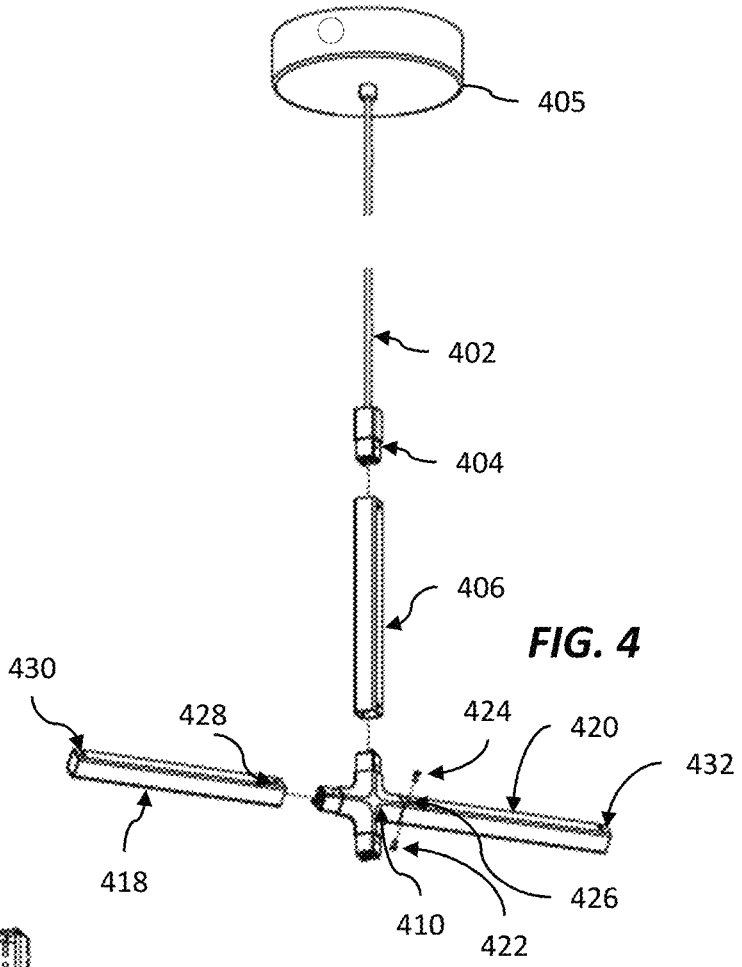
FIG. 4 is a perspective view of an example of a number of elongated connecting members connecting to a hub device.
Figure 5:
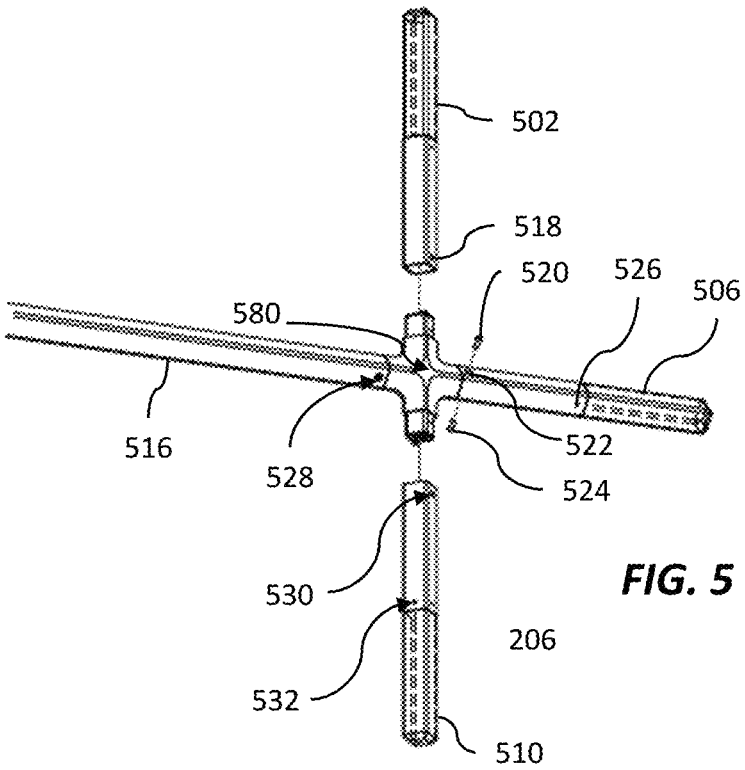
FIG. 5 is a perspective view of an example of a number of LED lighting elements connecting to a hub device.

As illustrated in FIG. 3, the interface device 115 may be configured as interface device 318 having a transfer junction 320 (404 in FIG. 4). The power converter 305, 405 and the wire 312, 402 in FIGS. 3 and 4 are substantially the same as the power converter 105 and the wire 110 described above with respect to FIG. 1. The transfer junction 320 may include a smaller cross-section portion that is configured to be received in a receiving portion or socket portion of one or more connecting elements such as connecting elements 406, 418, or 420 illustrated in FIG. 4 (516 and 518 in FIG. 5). In such a configuration, and as illustrated in FIG. 3, the transfer junction 320 may further comprise a transfer junction connecting element 322 (e.g., 710, 712 of FIG. 7*a*) having at least two contact pads (e.g., 718, 720 and 714, 716 of FIG. 7*a*). The transfer junction connecting element 322 may be, for example, a printed circuit board having two contact pads thereon. The contact pads (e.g., 718, 720 and 714, 716 of FIG. 7*a*) may be made of any suitable conductive material and be substantially flat on the surface facing outward from the interface device 318 and have corresponding though not necessarily identical pads on the inward facing surface of the PCB for connecting to one or more wires supplying power from the power converter 305.

Alternatively, as will be described in more detail below with reference to various connecting elements, such as elongated connecting members, the interface device 318 may be configured to have a transfer junction comprising a receiving portion configured to receive the transfer junction structure described with reference to transfer junction 320. In such a case, pins would protrude the surface of the transfer junction connecting element 322 and connect to one or more wires for supplying power from the power converter 305.

Returning to FIG. 1, the interface device 115 is coupled to a connecting element 120 which is coupled to connecting element 125. Connecting element 125 is in turn coupled to connecting element 140 which is in turn coupled to connecting element 145. Connecting elements 125 and 145 are additionally coupled to one or more light emitting diode lighting circuit devices 130, 160, 165. Connecting element 120 is an elongated connecting member mechanically coupled to interface device 115 by sliding a receiving portion of the transfer junction of the connecting element 120 over the transfer junction of the interface device 115.

Figure 10:
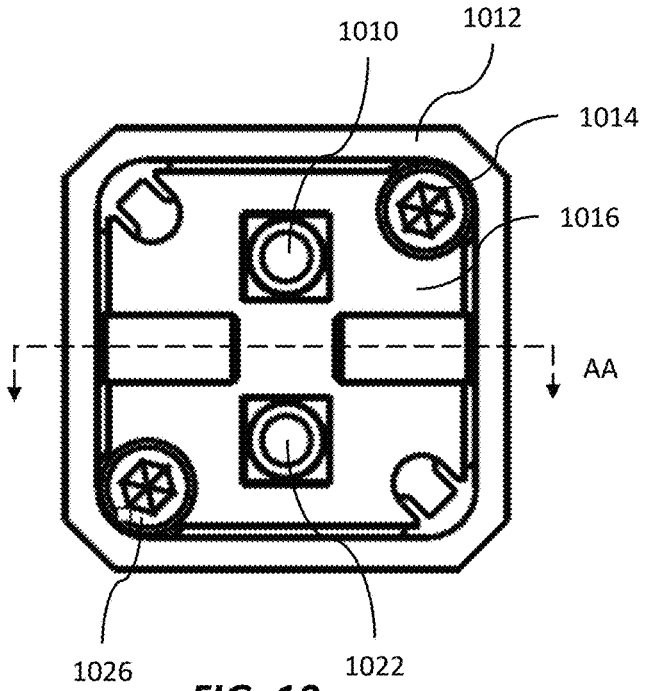
FIG. 10 is an end view of an example of an elongated connecting member.
Figure 11:
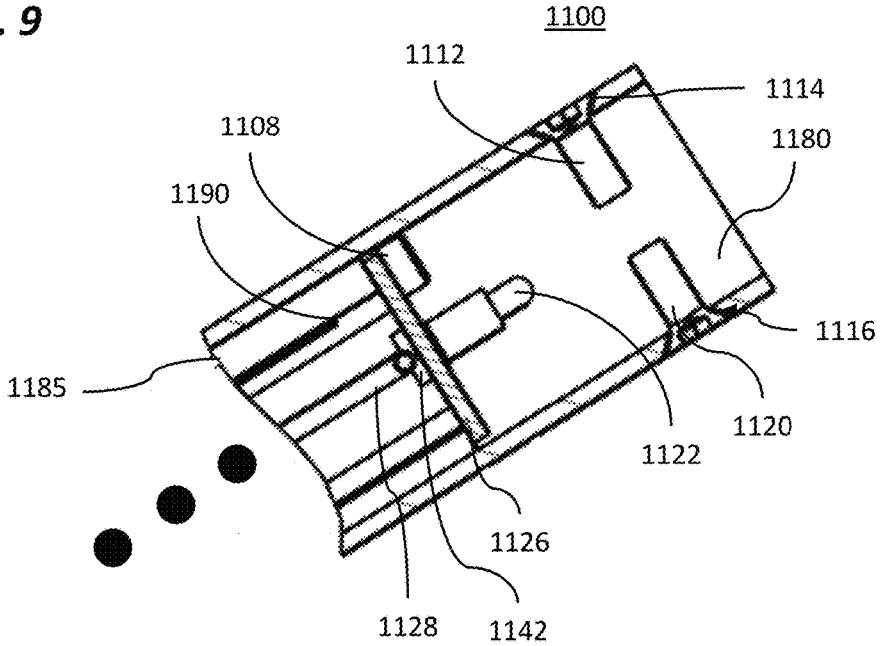
FIG. 11 is a cross-sectional view taken along line AA of FIG. 10.

FIG. 11 illustrates a cross-section of an elongated connecting element (e.g., 120, 140, 216, 228, 236, 406, 418, 420, 516) cut along line AA of FIG. 10. The receiving portion 1180 receives the transfer junction (e.g., 320) of the interface device 115 and then is set in place using, for example, set screws (1112, 1120) threaded into countersunk holes 1114, 1116. The transfer junction of an elongated connecting member, such as elongated connecting member 1100, is the portion of the elongated connecting member including the transfer junction connecting member 1126 and outward of the transfer junction connecting member 1126.

FIG. 4 illustrates connecting element 420 receiving a transfer junction of the connecting element 410. Set screws 422 and 424 will be inserted and tightened to complete the mechanical coupling between connecting element 410 and connecting element 420. The interface device 115 is likewise coupled to the connecting device 120.

The transfer junction connecting element of the connecting element 120 is recessed with pins protruding from its outward facing surface. FIGS. 10 and 11 illustrate the structure of an elongated connecting member. In FIGS. 10 and 11, the transfer junction connecting element 1016, 1126 is recessed in the elongated connecting member housing 1012, 1185 and secured in place by screws 1014, 1026 and 1108 (the other screw is not illustrated in the cross-section of FIG. 11). The transfer junction connecting element 1016 has two pins 1010, 1022 protruding out of its outward facing surface and configured to make electrical contact with the pads of, for example, the transfer junction connecting element of the interface device 115. The terminal ends or heads of the pins 1010, 1022 are substantially round or hemispherical and configured to maintain electrical contact with, for example, the pads of the transfer junction connecting element of interface device 115.

Figure 9:
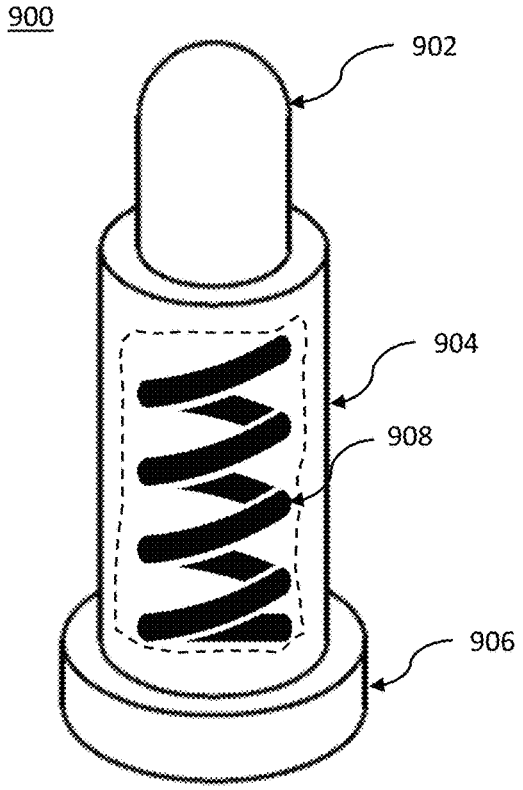
FIG. 9 is a perspective view of an example of a pin.

FIG. 9 illustrates the structure of the pins (e.g., 1010, 1022, 1122) disclosed herein. The pin 900 is comprised of a pin head 902, a body 904 and a base 906. In one embodiment the pin head 902, body 904, and base 906 form a rigid, annular structure. In another embodiment, the pin 900 comprises a body portion 904, a head portion 902, and a base portion 906 each having an annular shape. The body portion 904 extends from the base portion 906, and the head portion 902 extends from the body portion 904. In one form, pin 900 may be a single, unitary component.

Alternatively, the body portion 904 may be hollow with the head portion 902 extending telescopically outward from the body portion 904. The head portion 902 may reciprocate axially relative to the body portion 904 to change the amount of the head portion 902 extending out from the hollow body portion 904. A spring 908 in the hollow body portion 904 may be configured to apply a mechanical force against both the base portion 906 and the head portion 902 so as to fully extend the head portion 902 out of the body portion 904 when no counteracting force is applied to the head portion 902. The spring 908 may, for example, maintain the head portion 902 in a fully extended position by applying a force to an annular base of the head portion 902, which may have a greater radius than the portion of the head portion 902 extending out of the body portion 904. The head portion 902 extending from the body portion 904 may extend through an opening with an inner radius that is slightly larger than the outer radius of the extending head portion 902. The clearance between the two can allow freedom of movement but also provide axial guidance without lateral movement. The pin retaining surface receives the force of the spring through the annular base of the head portion 902.

It has been found that the non-flat, and preferably the hemispherical, pin head structure of the pin 900 provides superior connectivity over other pin structures in modular LED light fixtures, such as the modular LED light fixture 100, 200 because they maintain a superior electrical connection with the pads under various installation conditions. The electrical connections between connecting elements and between connecting elements and light emitting diode lighting circuit devices in connection with the disclosed embodiments are achieved by mechanical contact between a pair of pins and a pair of pads, and that it is the mechanical contact between the pins and the pads that establishes the electrical connection that supplies power from the power converter 105 (205, 305, 405) to the LED lighting elements. Poor contact at any transfer junction compromises electrical power supplied to all transfer junctions electrically downstream of the transfer junction having poor contact, and thus, a proper connection is desired at each transfer junction so that the LED fixture operates at its intended capacity, including as a usefulness light source and as a decorative lighting fixture with aesthetic value. Thus, the length of pin and/or the bias of the spring should be coordinated to ensure there is a good connection without damage to the pads. If the pin is too short and/or the spring is too weak, the connection may not be good. If the pin is too long, it may damage the pad and other interface.

As seen in FIG. 11, the base 1142 of the pin 1122 prevents the pin from passing through the transfer junction connecting element 1126. A wire 1128 is coupled to the pin 1122 at the base 1142 and runs through the elongated connecting member 1100 and connects to the base of a pin on the opposite end of the elongated connecting member 1100. The opposite end of the elongated connecting member 1100 is a mirror image the end of the elongated connecting member 1100 illustrated in FIG. 11. The screw 1108 secures the transfer junction connecting element 1126 to the elongated connecting member housing 1185 by securing it to ledge portion 1190. The ledge portion 1190 may be integral with the elongated connecting member housing 1185. Screws 1014 and 1026 similarly connect the transfer junction connecting element 1016 to the elongated connecting member housing 1012.

The connecting elements (125, 145, 214, 222, 230, 244, 410, 580) are hubs. A hub connects to elongated connecting members, for example 120, 140, and between elongated connecting members, for example 120, 140, and light emitting diode lighting circuit devices, for example 130, 160, 165. Both elongated connecting members and hubs have screw receiving portions designed to overlap when, for example, a transfer junction of a hub is slid into a receiving portion of an elongated connecting member. The set screw receiving portions are labelled (non-exhaustively) through the figures as 426, 428, 430, 432, 522, 526, 528, 530, 532, 604, 608, 612, 616, 624, 626, 628, 630, 632, 634, 640, 642, 644, 646, 730, 732, 734, 736, 808, 810. Set screws 422, 424, 520, 524, 824, 826 are used to complete the mechanical coupling between connecting elements and between connecting elements and light emitting diode lighting circuit devices. The screws may alternatively be push fasteners that snap into the screw receiving portions or rivets.

Figure 6A:
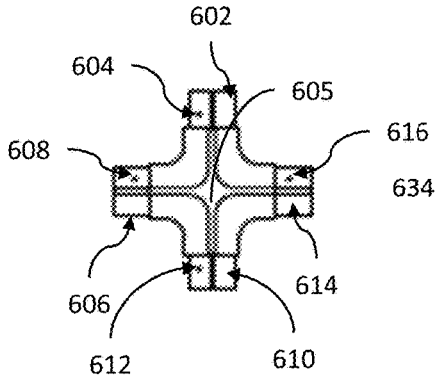
FIG. 6*a* is a plan view of an example of a hub having four transfer junctions.
Figure 6B:
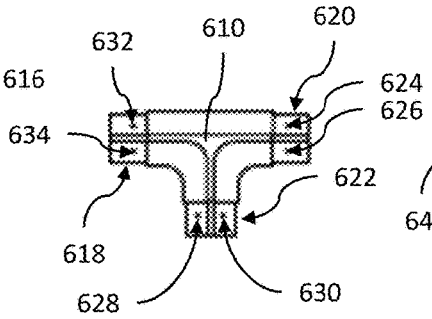
FIG. 6*b* is a plan view of an example of a hub having three transfer junctions.
Figure 6C:
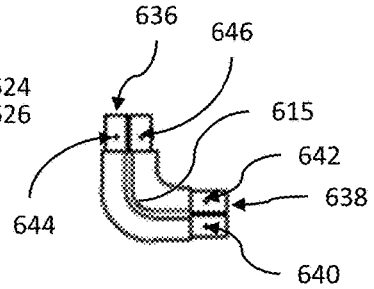
FIG. 6*c* is a plan view of an example of a hub having two transfer junctions.

FIGS. 6*a*, 6*b*, and 6*c* illustrate different hub structures. FIG. 6*a* illustrates a hub having a body 605 with four transfer junctions 602, 606, 610, and 614. FIG. 6*b* illustrates a hub having a body 610 with three transfer junctions 618, 620, and 622. FIG. 6*c* illustrates a hub having a body 615 with two transfer junctions 636, 638.

Figure 7A:
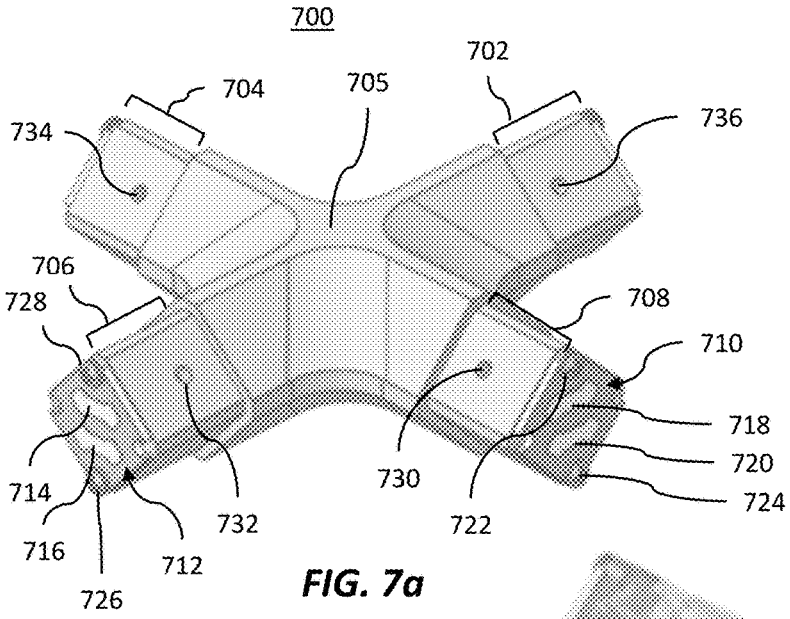
FIG. 7*a* is a perspective view of an example of a four-transfer-junction-hub having transfer junction pad.

FIG. 7*a* illustrates a hub 700 that is a three-dimensional representation of the hub of FIG. 6*a*. The hub 700 has four transfer junctions 702, 704, 706, 708 and a body 705. Each of the transfer junctions 702, 704, 706, 708 has a transfer junction connecting element (e.g., 710, 712). Each of the transfer junction connecting elements coupled to transfer junctions 702, 704, 706, 708 is substantially the same and will be described in view of the transfer junction connect elements 710, 712.

Figure 7B:
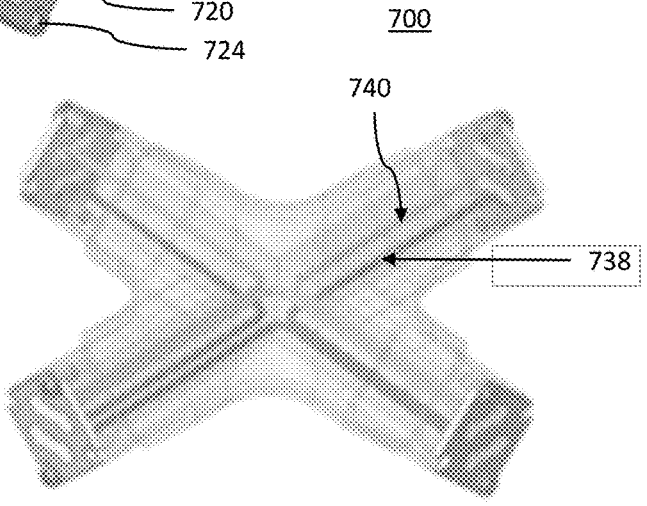
FIG. 7*b* is a perspective view of an example of the internal wiring of a four-transfer-junction-hub.

The transfer junction connecting elements 710, 712 are fastened to the hub 700 via screws 722, 724 and 726, 728. The transfer junction connecting elements 710, 712 have transfer junction contact elements configured as pads 718, 720 and 714, 716. The pads 714, 716, 718, 720 are substantially flat and configured to be contacted by a pin to transmit an electrical current. The side of the transfer junction connecting elements 710, 712 facing inward towards the body 705 of the hub 700 is configured to be coupled to wire such as wires 738, 740 of FIG. 7*b*. The wires 738, 740 are coupled to the pads of the hub 700 so as to keep the voltage in the same polarity for each pad. The polarity is maintained by the internal wiring of the elongated connecting members.

Figure 8:
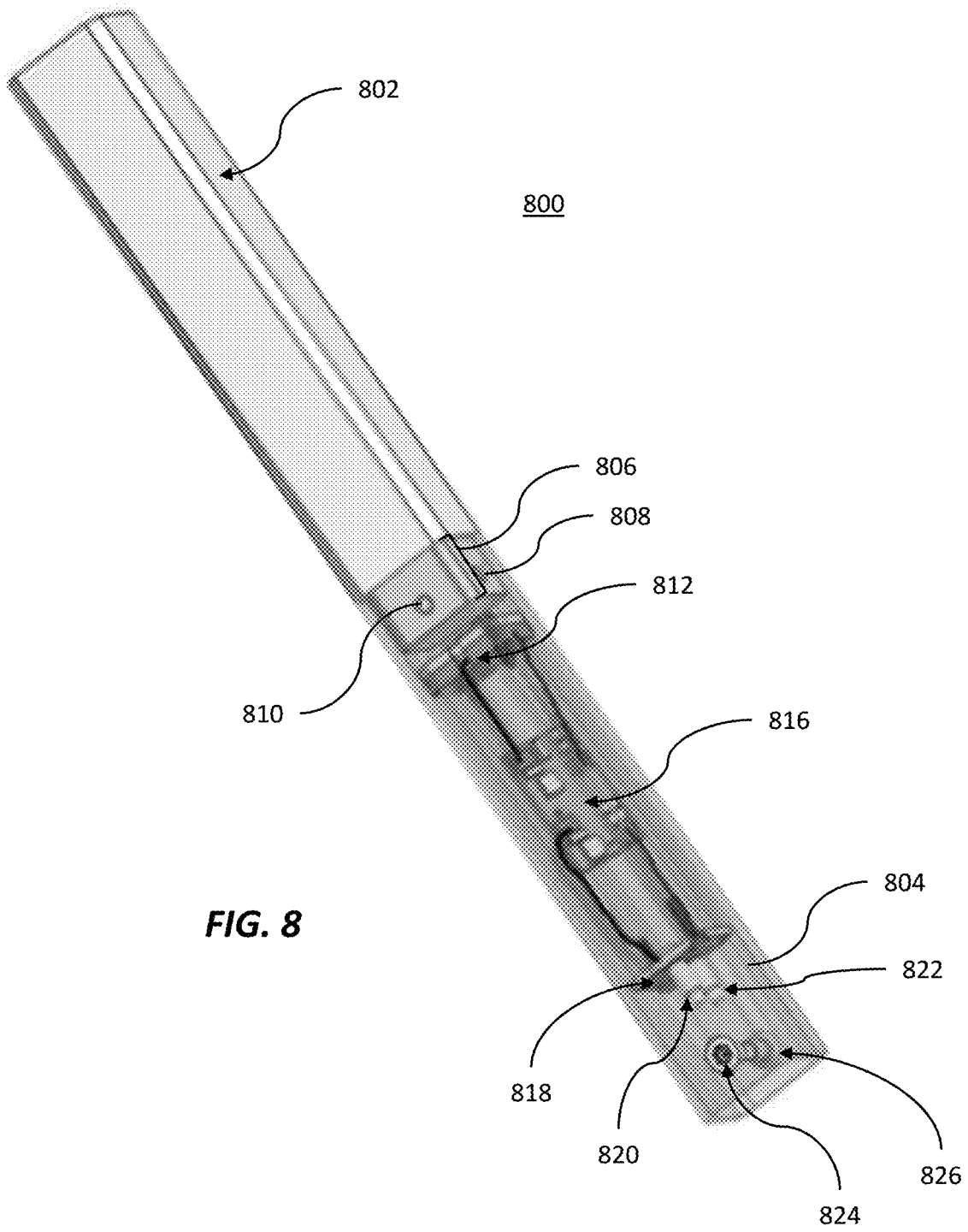
FIG. 8 is a perspective view of an example of a light emitting diode lighting circuit device with the housing portion 804 illustrated as being transparent for the purpose of showing the internal workings of the light emitting diode lighting circuit device.

A light emitting diode lighting circuit device (such as 130, 160 and 165 of FIGS. 1, 202, 204, 206, 218, 226, 234, 238, 242, and 248 of FIG. 2, and 502, 506 and 510 of FIG. 5) are illustrated in detail in FIG. 8. The light emitting diode lighting circuit device 800 is comprised of a housing portion 804 and a light diffuser 802. The light diffuser 802 has a light transfer junction 806 with a smaller cross-section than that of the rest of the light diffuser 802 for coupling the light diffuser 802 to the housing portion 804. The light diffuser 802 is secured to the housing portion 804 by inserting a fastener such as a set screw through the housing portion 804 and into the screw receiving portions 808, 810. The set screws 824, 826 are configured to secure the light emitting diode lighting circuit device 800 to a connecting element, such as a hub or an elongated connecting member, that supplies electric power to the pins 820, 822 of the transfer junction connecting element 818. The transfer junction connecting element 818 is substantially the same as the transfer junction connecting elements 1016, 1126 described above in FIGS. 10 and 11. The pins 820, 822 are electrically coupled to the polarity circuit 816, and the polarity circuit is in turn electrically coupled to the LED lighting element 812, such as modular LED light fixture 100 and 200.

When the light emitting diode lighting circuit device 800 is connected to a hub or an elongated connecting member, the voltage received from the hub or the elongated connecting member creates a voltage across the pins 820, 822 that may be in either a forward bias or a reverse bias relative to the LED lighting element 812. Without the polarity circuit 816, connecting the light emitting diode lighting circuit device 800 to power supplied from a hub or elongated connecting member would run the risk of incorrectly installing the light emitting diode lighting circuit device 800, and thus, the LED lighting element 812 in reserve bias. As described above, installing LED lighting elements in a reverse bias may increase assembly time and risk burning out the LED lighting element 812 when a modular LED light fixture is powered.

Figure 12:
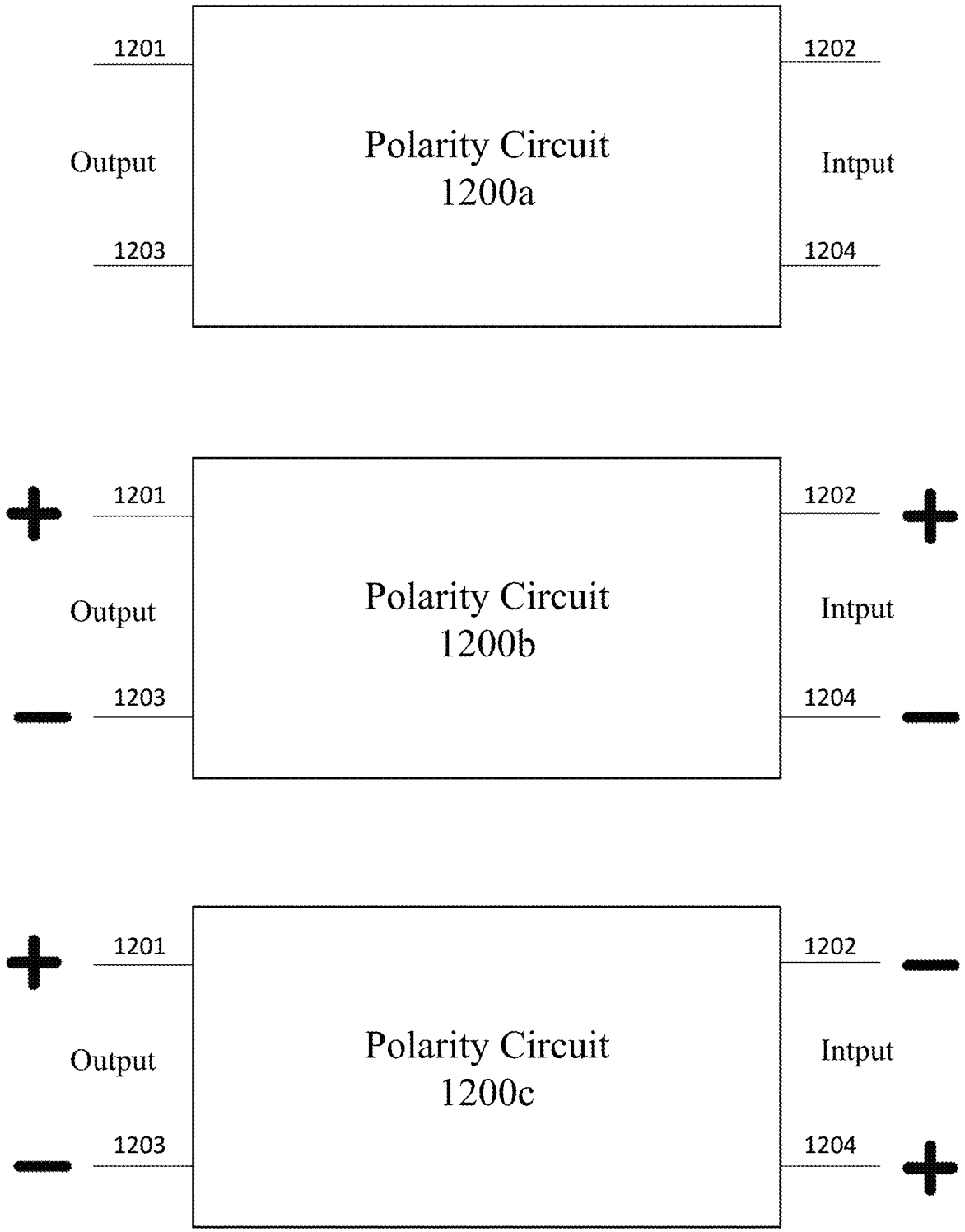
FIG. 12 illustrates the function of a polarity circuit for maintaining output voltage polarity regardless of input voltage polarity.

However, the polarity circuit 816 prevents the LED lighting element 812 from receiving a voltage in a reversed bias by providing a forward bias voltage to the LED lighting element 812 regardless of polarity of the voltage input into the polarity circuit 816 from the pins 820, 822. The polarity of the voltage across the input 1202, 1204 of the polarity circuit 816 illustrated in 1200*a* of FIG. 12 corresponds to the polarity of the voltage across the pins 820, 822 of FIG. 8. As can be seen in 1200*b* and 1200*c*, regardless of the polarity across the input 1202, 1204 the polarity across the output 1201, 1203 of the polarity circuit 816 remains the same. Thus, the LED lighting element 812 needs only to be installed in forward bias relative to the output voltage of the polarity circuit 816. As such, there is no chance that LED lighting element 812 receives a reverse polarity voltage based on the voltage provided across the pins 820, 822 because the polarity of the LED lighting element 812 relative to the output of the polarity circuit 816 is fixed as forward bias at the time of manufacture. The polarity circuit 816 may be, for example, a CMOS polarity circuit or any other circuit configured to maintain a constant output voltage polarity regardless of the input voltage polarity. For example, a pair of PMOS and a pair of NMOS transistors may be configured to provide a constant output voltage polarity regardless of the input voltage polarity in a manner known to those of ordinary skilled in the art such as those disclosed in U.S. Pat. No. 4,139,880 to Ulmer et al. entitled "CMOS POLARITY REVERSAL CIRCUIT" which is hereby incorporated by reference in its entirety.

Figure 2:
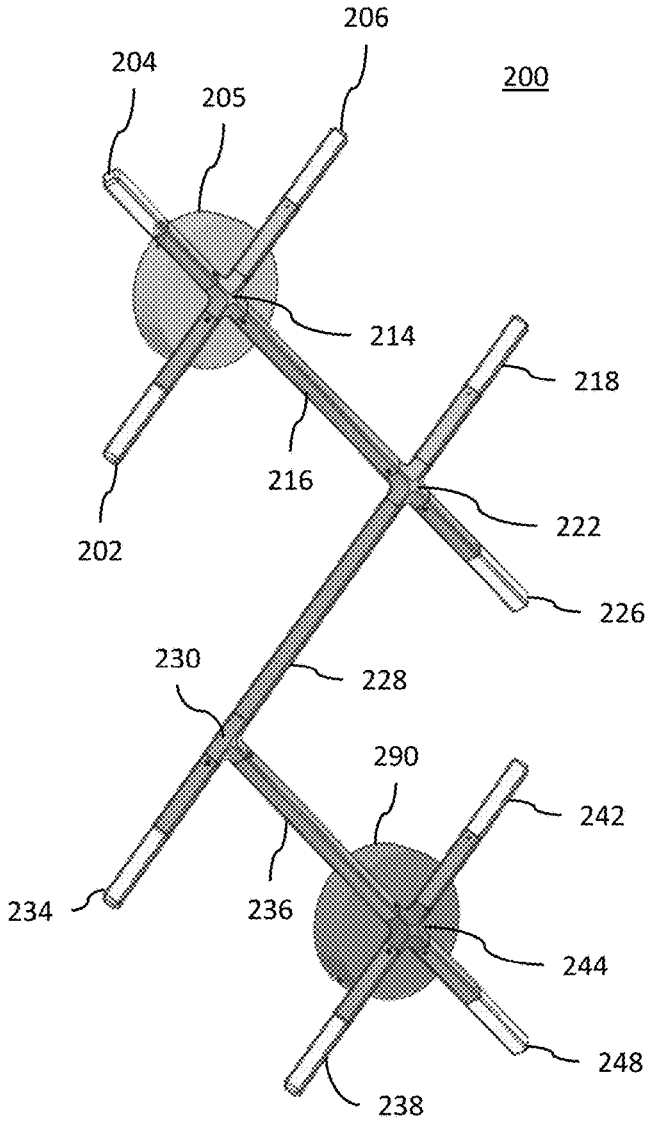
FIG. 2 is a perspective view of an example of a modular LED fixture designed to be installed on a wall.

FIG. 2 illustrates an alternative configuration of a modular LED fixture. The modular LED fixture 200 is comprised of modular components including power converter 205 coupled to light emitting diode lighting circuit device 202, 204, 206, 218, 226, 234, 238, 242, and 248; hubs 214, 222, 230, and 244; and elongated connecting members 216, 228, and 236, through the coupling of these elements. Each of these modular elements is coupled in substantially the same way as described above. The modular LED fixture 200 is an example of a modular LED fixture configured to be installed on a wall. The modular LED fixture 200 includes an anchor point 290 for fastening the modular LED fixture 200 to the wall to support its weight as the size of the modular LED fixture 200 grows. Though only two anchor points are illustrated (the power converter 205 also serves as an anchor point), the modular LED fixture 200 may include any number of anchor points required to support the weight of the fixture.

Those skilled in the art will recognize that a wide variety of modifications, alterations, and combinations can be made with respect to the above described embodiments without departing from the scope of the disclosure. Such modifications, alterations, and combinations are to be viewed as being within the ambit of the present disclosure.

What is claimed is:

1. A modular light emitting diode lighting fixture comprising:

a power converter to convert alternating current power to a direct current power;

a first connecting element coupled to the power converter and comprising at least one first transfer junction connecting element;

a light emitting diode lighting circuit device coupled to the power converter through the first connecting element, the light emitting diode lighting circuit device comprising:

at least one light emitting diode;

at least one second transfer junction connecting element; and a polarity circuit coupled to the at least one second transfer junction connecting element and the at least one light emitting diode and configured to maintain the voltage across the at least one light emitting diode in a first polarity regardless of the polarity of the voltage across the at least one second transfer junction connecting element, wherein the at least one first transfer junction connecting element comprising transfer junction contact elements selected from a group comprising a pin or a pad, and the at least one second transfer junction connecting element comprising transfer junction contact elements selected from a group comprising a pin or a pad, wherein the first and second transfer contact elements are electrically coupled by contact between at least two pins and at least two pads, the pins having a substantially hemispherical head for contacting the pads.

2. The modular light emitting diode lighting fixture of claim 1 wherein the pad is substantially flat.

3. The modular light emitting diode fixture of claim 1 wherein the first connecting element is a hub having at least two transfer junction connecting elements, and wherein each of the at least two transfer junction connecting elements comprises at least two transfer junction contact elements configured as pads.

4. The modular light emitting diode fixture of claim 1 wherein the first connecting element is a hub having at least two transfer junction connecting elements, and wherein each of the at least two transfer junction connection elements comprises at least two transfer junction contact elements configured as pins.

5. The modular light emitting diode fixture of claim 1 wherein the first connecting element is an elongated connecting member having at least two transfer junction connecting elements arranged with transfer junction contact elements facing outwards, and wherein each of the at least two transfer junction connecting elements comprises at least two transfer junction contact elements configured as pads.

6. The modular light emitting diode fixture of claim 1 wherein the first connecting element is an elongated connecting member having at least two transfer junction connecting elements arranged with transfer junction contact elements facing outwards, and wherein each of the at least two transfer junction connecting elements comprises at least two transfer junction contact elements configured as pins.

7. The modular light emitting diode fixture of claim 1 wherein the pins are rigid and the mechanical coupling between the first connecting element and the light emitting diode lighting circuit device supplies the force need to maintain the electrical coupling.

8. The modular light emitting diode fixture of claim 1 wherein the pins comprise a body portion, a head portion, and a base portion of different cross-sections, the base portion coupled to the body portion and the head portion housed at least partially within the body portion and configured to reciprocate in and out of the body portion.

9. The modular light emitting diode fixture of claim 8 further comprising a spring housed within the body portion of the pins and configured to apply mechanical force against the head portion.

* * * * *